United States Patent [19]

Gerry

[11] 4,139,804

[45] Feb. 13, 1979

[54] TRANSIENT MODULATED IGNITION SYSTEM

[76] Inventor: Martin E. Gerry, 13452 Winthrope St., Santa Ana, Calif. 92705

[21] Appl. No.: 814,457

[22] Filed: Jul. 11, 1977

[51] Int. Cl.[2] ..... H05B 37/02; H05B 39/04; H05B 41/36

[52] U.S. Cl. ..... 315/209 R; 123/148 E; 315/166; 315/170; 315/176

[58] Field of Search ..... 315/209 R, 209 T, 209 M, 315/213, 172, 214, 176, 215, 216, 170, 171, 209 CD, 166, 167; 307/264; 123/148 E, 148 DC; 361/253, 263

[56] References Cited

U.S. PATENT DOCUMENTS

| | | | |
|---|---|---|---|
| 3,950,693 | 4/1976 | Mitsuoka | 307/264 |
| 3,972,315 | 8/1976 | Munden et al. | 123/148 E |
| 4,033,316 | 7/1977 | Birchenough | 315/176 |

*Primary Examiner*—Saxfield Chatmon, Jr.

[57] ABSTRACT

An ignition system providing a transient waveform intermodulates with an AC waveform in an ignition transformer to provide higher voltage and current outputs for longer periods of time than conventional systems. A simple, reliable and inexpensive timing device is provided for generation of the transient waveform at predetermined intervals.

10 Claims, 6 Drawing Figures

TRANSIENT MODULATED IGNITION SYSTEM

RELATED APPLICATION

This application is related to one filed by the same inventor and entitled: Modulation Ignition System, serial number 812,912, filed July 5, 1977.

BACKGROUND OF THE INVENTION

This invention is in the field of ignition systems and more particularly in such systems utilizing generated transients intermodulated by an AC waveform.

No art exists in the field of these systems except one invention as hereinabove identified under the caption of Related Application.

SUMMARY OF THE INVENTION

It is therefore an object of this invention to provide a system that produces a transient waveform and modulates such transient waveform with an AC signal of predetermined shape, in order to produce a high energy ignition system that operates at reasonable voltages but delivers substatially higher current levels to the igniters over greater periods of firing time than conventional systems are capable of delivering.

Accordingly, an ignition system is provided having an ignition transformer and including first means, driven during operative mode of the system, for electrically shunting the input of the transformer and for initiating a transient signal, and second means, electrically coupled to the input of the transformer and the first means, for providing AC power which intermodulates with the transient signal during said operative mode.

The second means may have a multi-ended output terminal one end of which may be electrically at DC potential other than ground potential, or such one end may be at DC potential which is also ground potential.

The first means includes a wheel of electrically conductive material at ground potential and having insulating members regularly positioned at the wheel periphery within the confines of the wheel, and an electrical contactor, in constant cooperation with the periphery, electrically connected to the input of the transformer. Another end of the output terminal is electrically coupled to the input of the transformer.

Third means are provided, which may be part of the second means if desired, electrically intermediate the first and second means, for providing an impedance match between the transformer and the second means during the operative mode, in the situation where such impedances are not normally matched to provide maximum power transfer absent the third means. Such third means may be a capacitor, or other suitable network.

DETAILED DESCRIPTION

Figure 1:
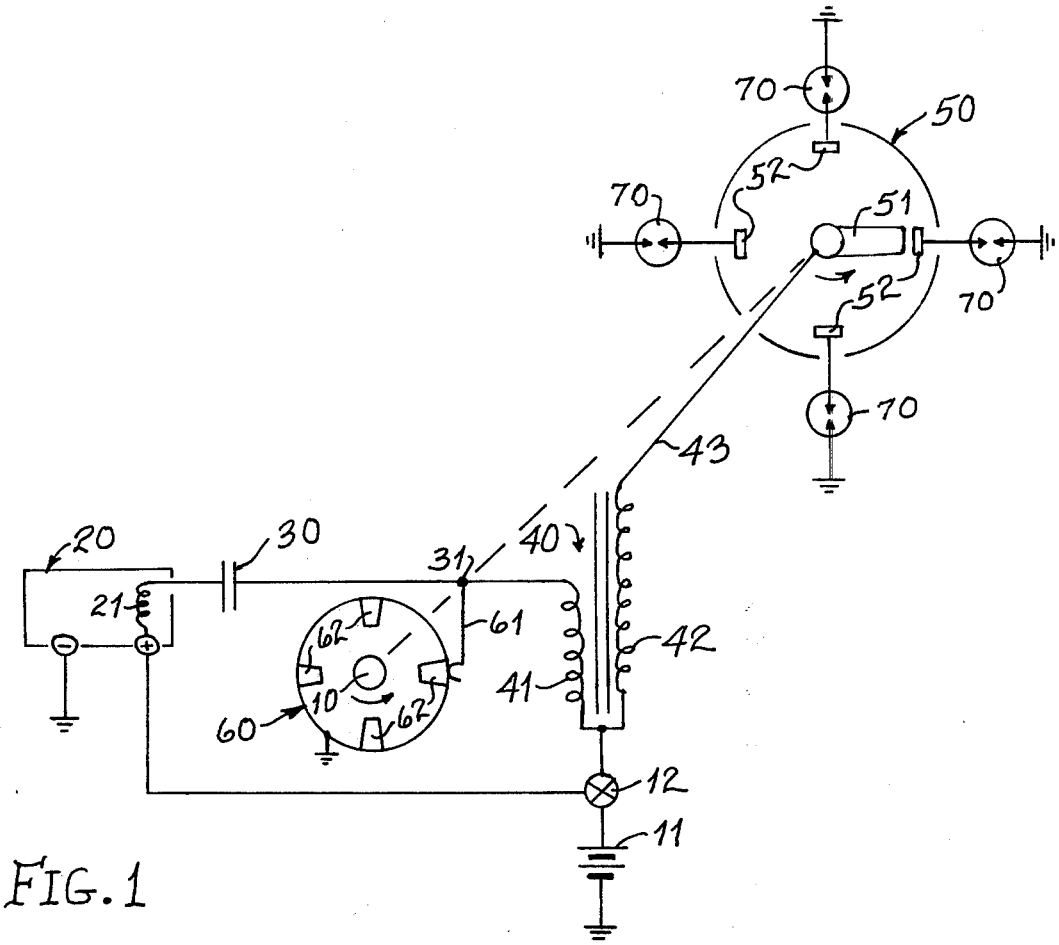
FIG. 1 is an electro-mechanical schematic of a transient modulated ignition system according to the invention.

Referring to FIGS. 1–4, a modulation ignition system is provided wherein an intermittently generated transient signal is modulated by a rectangular wave. The generated transient may also be modulated by any other alternating wave or pulsed signal.

The system uses a simple timing wheel and electrical contactor, intermittently generating the transient wave, which timing wheel is mounted on distributor shaft 10 which also drives rotor 51 of conventional distributor 50, wherein distributor 50 has stationary members 52 each connected to an electrical igniter 70. The conventional ground symbol is used throughout to indicate both negative battery potential and signal return path, and same will be so understood and need not be referred to hereinbelow.

The rectangular or other wave is provided by high power signal source 20, generally having an output transformer in its circuit, the output winding of which is shown at 21.

In one type of connection, DC positive potential is provided by battery 11 through ignition switch 12 and fed to the positive terminal of source 20 to which is also connected one end of output winding 21. In another type of connection, no DC positive potential from the battery is fed to the output winding, such output winding being at ground potential at one end thereof. The other end of the output winding 21 is connected to a capacitor 30 which is used as a match of impedance of source 20 at its output with the impedance of transformer 40 at its input, the other end of capacitor 30 being connected to a junction point 31 and to one end of primary 41 of transformer 40.

Junction point 31 has an electrically conductive contactor 61 connected thereto, which contactor may have a shank or armature of spring steel or of beryllium copper to also provide flexibility as the contact end thereof is in constant cooperation with the periphery of timing wheel 60. The body of wheel 60 is of electrically conductive material and is at ground potential since it is mounted at its center on distributor shaft 10 which is at ground potential. Such wheel has a number of electrically insulating insert members 62 equal to the number of cylinders of the engine to which the system is adapted, in this illustration to a four cylinder engine and hence wheel 60 has four inserts. Such inserts are permanently molded into the wheel so that the outer periphery of the wheel has the appearance of a motor commutator. Consequently the contact end of contactor 61 would be in constant cooperation with the periphery of the wheel including the inserts therein. The wheel and distributor rotor are shown coupled to each other by shaft 10 driven in counterclockwise direction as indicated by the arrows on the wheel and at the distributor. Such wheel is a substitute for points normally used in ignition systems, but without the disadvantages of contact bounce since a surface sliding action is involved. Hence, the components in the primary transformer circuit are charged with DC during period when contactor 61 is not in cooperation with members 62, and the igniters are fired when contactor 61 is in full cooperation with any of members 62.

The side of primary 41 opposite to the side that is connected to junction point 31, is normally joined in a conventional ignition transformer to one side of secondary 42, and their juncture connected to ignition switch 12. The other side of secondary 42 is connected by wire 43 to distributor rotor 51 in the usual manner.

Figure 3:
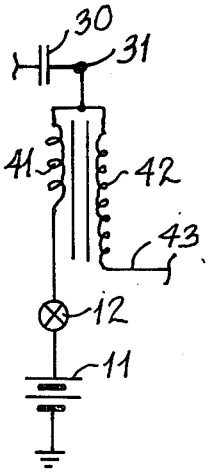
FIGS. 3 and 4 are schematics showing different methods of interconnecting an ignition transformer in the system of FIGS. 1 and 2.
Figure 4:
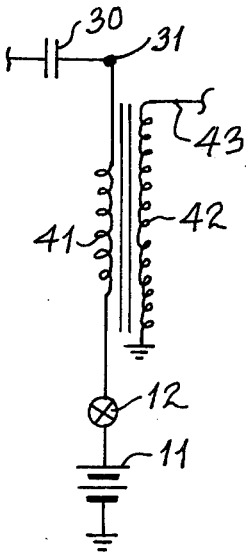

Other connections as per FIG. 3 where the juncture of primary and secondary are connected to 31 and the other side of the primary to the ignition switch, or as per FIG. 4 where primary and secondary do not have a common juncture so that the side opposite to wire 43 connection of secondary 42 is at ground potential, constitute the identical circuits functionally as that of FIG. 1, since the primary and secondary circuits in all these cases are hard-wire electrically independent of each other.

Figure 5:
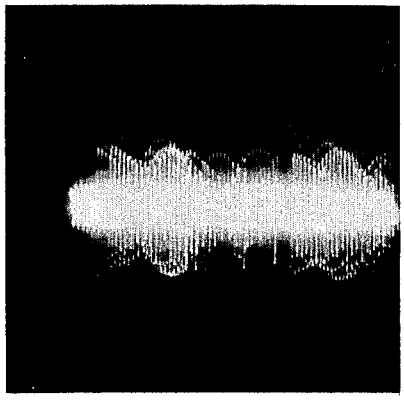
FIG. 5 is an oscillographic photograph showing the intermodulation pattern of the system of FIG. 1.
Figure 6:
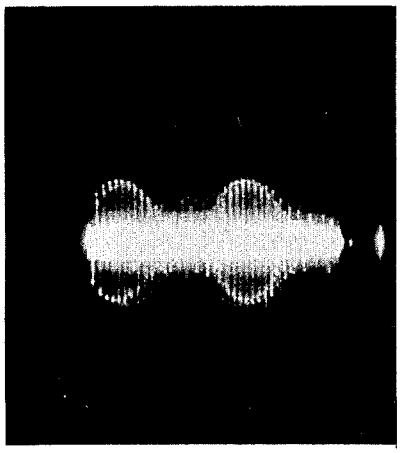
FIG. 6 is an oscillographic photograph showing the intermodulation pattern of the system of FIG. 1 as modified by FIG. 2.

Referring to FIGS. 1, 5 and 6, capacitor 30 in series with winding 21 form a parallel connection with primary winding 41. One end of this parallel connection has a common junction with ignition switch 12 and hence is at positive battery potential. All these components will be charged when wheel 60 is driven so as to cause contactor 61 to be intermediate any pair of inserts 62, since a return path to negative battery terminal will be provided by contactor 61 and the metallic portion of wheel 60 between junction point 31 and ground. Therefore in this mode there will develop higher initial conditions and a phase shift in the system to provide a more favorable output of the intermodulated wave as shown in FIG. 5, since the high transient peak of the transient wave developed by virtue of make-break action of wheel 60 with contactor 61 and the output wave of source 20 will create steeper intermodulation patterns closer to the beginning of the firing cycle, as evidenced by the sloping waveform of part of the modulation envelope. It was difficult to stop the oscillographic pattern completely due to changing in speed of the motor driving the distributor shaft in the laboratory set up when the photographs of FIGS. 5 and 6 were taken and hence there are overlapping swept patterns in both instances, making it difficult to see the spacing that exists between the modulation patterns between igniter firings.

Figure 2:
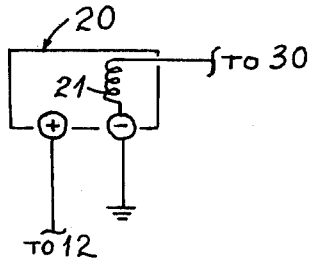
FIG. 2 is a schematic showing a slight modification of the system of FIG. 1.

Referring to FIGS. 1, 2 and 6, the oscillographic photograph does not show the steep wave front at initiation of ignition, but rather in the middle portion of ignition period. The reason is that the circuit used was that of FIG. 1 modified by FIG. 2 wherein output winding 21 is connected to ground instead of to ignition switch 12. Consequently, when wheel 60 is driven so that contactor 61 is intermediate two members 62, a short circuit is provided directly across the combination of compacitor 30 and winding 21, and only primary 41 is charged with the DC from battery 11 to provide inital condition only in winding 41. Thus the differences in the initial conditions upon firing when contactor 61 is fully on one of inserts 62, not cooperating with the metallic portion of wheel 60, removing the short circuit as discussed, FIG. 2 modified system will not have the benefit of initial charge in capacitor 30 and inductor 21, in this instance resulting in the modulated wave as in FIG. 6 with non-steep pattern at arc initiation. Such pattern is less advantageous than that obtained in FIG. 5, but nevertheless usefull since more timing advance of the firing would be required by positioning of shaft 10 a number of degrees in advance of piston top dead center by using conventional timing setting methods.

In FIGS. 1–4 the negative terminal of battery 11 is at ground potential. It is of course possible to have the battery terminals reversed where the negative terminal of the battery is connected to ignition switch 12 and the positive terminal thereof is at ground potential.

It is pointed out that although power source 20 normally is an electronic rectangular wave generator of between 2 and 10 kilohertz repetition rate having an output transformer the output winding of which is shown at 21, that a suitable power source such as 20 may be provided by tapping an output of the alternator normally in an automobile and connecting thereto a transformer the output winding thereof being a winding such as at 21.

What is claimed is:

1. An ignition system including an ignition transformer which has a primary winding and a secondary winding, comprising the combination of:

means, connected to the primary winding, for precharging the primary winding during a first mode of operation of the system and for initiating a transient signal during a second mode of operation of said system; and an AC source, electrically coupled to the primary winding and the means, for providing a generally rectangular waveform to the primary winding and for intermodulating said rectangular waveform with said transient signal during said second mode of operation.

2. The invention as stated in claim 1, including a capacitor in series circuit with said source.

3. An ignition system including an ignition transformer which has a primary winding and a secondary winding, comprising the combination of:

first means, driven during operative mode of the system, for intermittently shunting the primary winding of the transformer and for initiating a transient signal, said first means comprising:

a wheel of electrically conductive material at ground potential, said wheel having insulating members regularly positioned at the wheel periphery within the confines of the wheel; and an electrical contactor, in constant cooperation with said periphery, electrically connected to the primary winding of the transformer; and AC means, electrically coupled to the primary winding and the first means, for providing AC power to the primary winding and also for intermodulating said AC power with the transient signal during said operative mode, said AC means having a pair of output terminals one terminal of which is electrically at a potential other than ground potential.

4. The invention as stated in claim 3, wherein the other of the pair of output terminals is electrically coupled to the primary winding of the transformer.

5. The invention as stated in claim 3, including second means intermediate the first and AC means, for providing an impedance match between the transformer and the AC means during said operative mode.

6. The invention as stated in claim 5, wherein the second means is a capacitor.

7. An ignition system including an ignition transformer which has a primary winding and a secondary winding, comprising the combination of:

first means, driven during operative mode of the system, for intermittently shunting the primary winding of the transformer and for initiating a transient signal, said first means comprising:

a wheel of electrically conductive material at ground potential, said wheel having insulating members regularly positioned at the wheel periphery within the confines of the wheel; and an electrical contactor, in constant cooperation with said periphery, electrically connected to the primary winding of the transformer; and AC means, electrically coupled to the primary winding and the first means, for providing AC power to the primary winding and also for intermodulating said AC power with the transient signal during said operative mode, said AC means having a pair of output terminals one terminal of which is electrically at ground potential.

8. The invention as stated in claim 7, wherein the other of the pair of output terminals is electrically coupled to the primary winding of the transformer.

9. The invention as stated in claim 7, including second means intermediate the first and AC means, for providing an impedance match between the transformer and the AC means during said operative mode.

10. The invention as stated in claim 9, wherein the second means is a capacitor.

* * * * *